US012498123B2

(12) United States Patent
Sun

(10) Patent No.: US 12,498,123 B2
(45) Date of Patent: Dec. 16, 2025

(54) OUTDOOR HEAT EXCHANGER AND AIR CONDITIONER

(71) Applicant: Mitsubishi Electric Corporation, Tokyo (JP)

(72) Inventor: Faming Sun, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 303 days.

(21) Appl. No.: 18/246,765

(22) PCT Filed: Feb. 10, 2021

(86) PCT No.: PCT/JP2021/004957
§ 371 (c)(1),
(2) Date: Mar. 27, 2023

(87) PCT Pub. No.: WO2022/172359
PCT Pub. Date: Aug. 18, 2022

(65) Prior Publication Data

US 2023/0366565 A1 Nov. 16, 2023

(51) Int. Cl.
*F24F 1/14* (2011.01)
*F24F 1/26* (2011.01)

(52) U.S. Cl.
CPC . *F24F 1/14* (2013.01); *F24F 1/26* (2013.01)

(58) Field of Classification Search
CPC ... F24F 1/14; F24F 1/26; F25B 39/028; F25B 39/04; F25B 13/00; F25B 2313/0233;
(Continued)

(56) References Cited

U.S. PATENT DOCUMENTS

2012/0073786 A1 3/2012 Sakashita et al.
2016/0123645 A1* 5/2016 Kim ..... F25B 13/00 62/115
(Continued)

FOREIGN PATENT DOCUMENTS

CN 102460026 B * 5/2014 ..... F24F 1/0007
CN 112240654 A * 1/2021 ..... F24F 1/0059
(Continued)

OTHER PUBLICATIONS

International Search Report of the International Searching Authority mailed Mar. 23, 2021 in corresponding International Application No. PCT/JP2021/004957 (and English translation attached).

*Primary Examiner* — Kun Kai Ma
(74) *Attorney, Agent, or Firm* — Posz Law Group, PLC

(57) ABSTRACT

An outdoor heat exchanger includes a plurality of fins, a blower mechanism, a plurality of heat transfer pipes arranged side by side in a vertical direction, and a first flow divider connected to the plurality of heat transfer pipes. The plurality of heat transfer pipes includes a lowermost heat transfer pipe located on a lowermost side and at least one upper heat transfer pipe located above the lowermost heat transfer pipe. The upper heat transfer pipe includes a merging path connected to the first flow divider, a second flow divider provided at an end portion of the merging path, and at least two branch paths branched from the second flow divider, a flow resistance of a refrigerant in a liquid phase inside the upper heat transfer pipe is smaller than a flow resistance of the refrigerant in a liquid phase inside the lowermost heat transfer pipe.

12 Claims, 12 Drawing Sheets

(58) Field of Classification Search
CPC ..... F28D 1/024; F28D 2021/0068; F28D 1/0443; F28D 1/0477
See application file for complete search history.

(56) References Cited

U.S. PATENT DOCUMENTS

| | | | | |
|---|---|---|---|---|
| 2016/0348951 | A1* | 12/2016 | Matsumura | F25B 39/00 |
| 2022/0113069 | A1 | 4/2022 | Kanatani | |
| 2023/0366565 | A1* | 11/2023 | Sun | F24F 1/14 |

FOREIGN PATENT DOCUMENTS

| | | | | |
|---|---|---|---|---|
| EP | 3009771 | A1 * | 4/2016 | F25B 13/00 |
| JP | F102-068494 | A | 3/1990 | |
| JP | 2015-087074 | A | 5/2015 | |
| JP | 2016-084970 | A | 5/2016 | |
| JP | 2017-036860 | A | 2/2017 | |
| JP | 2018136121 | A * | 8/2018 | F24F 1/18 |
| JP | 6644194 | B1 * | 2/2020 | F24F 1/18 |
| WO | 2010/146852 | A1 | 12/2010 | |
| WO | WO-2014184912 | A1 * | 11/2014 | F16L 41/02 |
| WO | WO-2014184914 | A1 * | 11/2014 | F25B 39/00 |
| WO | WO-2016135935 | A1 * | 9/2016 | F25B 13/00 |
| WO | 2020/194517 | A1 | 1/2020 | |

* cited by examiner

OUTDOOR HEAT EXCHANGER AND AIR CONDITIONER

CROSS REFERENCE TO RELATED APPLICATION

This application is a U.S. national stage application of International Application No. PCT/JP2021/004957, filed on Feb. 10, 2021, the contents of which are incorporated herein by reference.

TECHNICAL FIELD

The present disclosure relates to an outdoor heat exchanger and an air conditioner.

BACKGROUND

An air conditioner generally includes an indoor system and an outdoor unit. The outdoor unit includes an outdoor heat exchanger and is configured to exchange heat between a refrigerant and air.

The outdoor heat exchanger disclosed in Patent Document 1 includes a plurality of heat transfer pipes arranged in a vertical direction and connected in parallel with each other. Each heat transfer pipe is provided with a plurality of fins, and heat exchange is performed between the refrigerant and the air through the fins. In Patent Document 1, in order to prevent an occurrence of a refrigerant drift in the lowermost heat transfer pipe, a structure is adopted in which a flow path length of the lowermost refrigerant path is longer than flow path lengths of other refrigerant paths.

PATENT DOCUMENT

Patent Document 1

Japanese Unexamined Patent Application, First Publication No. 2015-87074

In the structure proposed in Patent Document 1, since the flow path length of the lowermost refrigerant path is long, the pressure loss of the refrigerant inside the heat transfer pipe becomes large. When the pressure loss of the refrigerant is large, the problem arises in that the flow of the refrigerant is stagnant, resulting in a decrease in heat exchange performance.

SUMMARY

The present disclosure has been made in consideration of such circumstances, and an object thereof is to provide an outdoor heat exchanger with improved heat exchange performance.

In order to solve the above problems, an outdoor heat exchanger according to the present disclosure includes a plurality fins that are disposed at intervals; a blower mechanism that blows air into gaps between the fins; a plurality of heat transfer pipes which are arranged side by side in a vertical direction that intersects a direction in which the air flows, and through which a refrigerant that exchanges heat with the air via the plurality of fins flows; and a first flow divider connected to the plurality of heat transfer pipes, in which the plurality of heat transfer pipes include a lowermost heat transfer pipe located on a lowermost side and at least one upper heat transfer pipe located above the lowermost heat transfer pipe, the upper heat transfer pipe includes a merging path connected to the first flow divider, a second flow divider provided at an end portion of the merging path, and at least two branch paths branched from the second flow divider, and a flow resistance of the refrigerant in a liquid phase inside the upper heat transfer pipe is smaller than a flow resistance of the refrigerant in a liquid phase inside the lowermost heat transfer pipe.

According to the present disclosure, it is possible to provide an outdoor heat exchanger with improved heat exchange performance.

DETAILED DESCRIPTION

Hereinafter, heat exchangers according to embodiments of the present disclosure will be described with reference to the drawings.

First Embodiment

Figure 1:
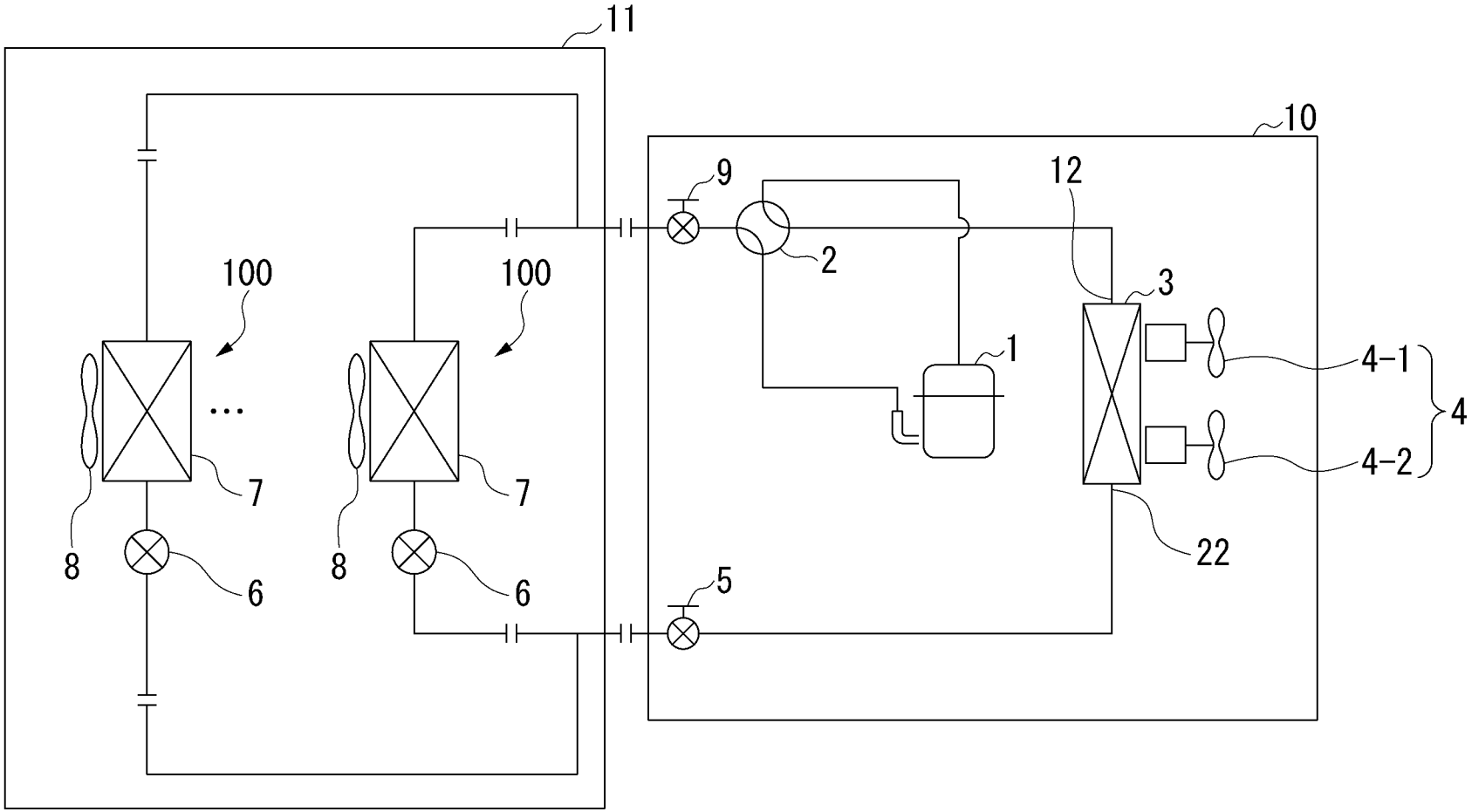
FIG. 1 is a configuration diagram of a refrigerant path of an air conditioner according to a first embodiment.

FIG. 1 is a configuration diagram of a refrigerant path provided in an air conditioner according to a first embodiment. As shown in FIG. 1, the air conditioner according to the first embodiment includes an outdoor unit 10 and an indoor system 11. The outdoor unit 10 and the indoor system 11 are configured such that a refrigerant circulates. In the following description, the refrigerant in a gas phase may be referred to as a "refrigerant gas", and the refrigerant in a liquid phase may be referred to as a "refrigerant liquid". In a case where no distinction is made between the gas phase and the liquid phase, it is simply referred to as a "refrigerant". In an example of FIG. 1, the indoor system 11 includes a plurality of indoor units 100. However, the number of the indoor units 100 included in the indoor system 11 may be one. Each indoor unit 100 includes an indoor heat exchanger 7 and an indoor blower mechanism 8. An expansion valve 6 is provided corresponding to each indoor unit 100. The outdoor unit 10 includes a compressor 1, a four-way valve 2, an outdoor heat exchanger 3, and a blower mechanism 4. In FIG. 1, the blower mechanism 4 includes an upper blower 4-1 and a lower blower 4-2. In addition, the blower mechanism 4 may be configured by one blower.

In a case where the air conditioner performs a cooling operation, a high-temperature and high-pressure refrigerant gas discharged from the compressor 1 flows into the outdoor heat exchanger 3 through the four-way valve 2. In the outdoor heat exchanger 3, the refrigerant gas exchanges heat with air sent by the blower mechanism 4 (the upper blower 4-1 and the lower blower 4-2) and condenses to become a refrigerant in a liquid phase (refrigerant liquid). Furthermore, the refrigerant liquid flows into the indoor system 11 through a liquid valve 5 of the outdoor unit 10. The refrigerant liquid that has flowed into the indoor system 11 flows toward each indoor unit 100 through each expansion valve 6. The refrigerant liquid exchanges heat with the air blown by the indoor blower mechanism 8 in the indoor heat exchanger 7 and evaporates to become the refrigerant gas. At this time, the refrigerant takes thermal energy from the air in the room, so that the air can be cooled. The refrigerant gas evaporated in the indoor heat exchanger 7 returns to the compressor 1 through a gas valve 9 of the outdoor unit 10. The above is a cycle of the refrigerant in a case where the air conditioner performs a cooling operation.

In a case where the air conditioner performs a heating operation, the high-temperature and high-pressure refrigerant gas discharged from the compressor 1 flows into the indoor system 11 through the four-way valve 2 and the gas valve 9. The refrigerant gas flows toward each indoor unit 100 included in the indoor system 11. Furthermore, the refrigerant gas exchanges heat with the air blown by each indoor blower mechanism 8 in each indoor heat exchanger 7 and condenses to become a refrigerant liquid. At this time, the refrigerant gives thermal energy to the air in the room, so that the air can be warmed. The refrigerant liquid condensed in each indoor unit 100 returns to the outdoor unit 10 through the expansion valve 6. Furthermore, the refrigerant liquid flows toward the outdoor heat exchanger 3 through the liquid valve 5. In the outdoor heat exchanger 3, the refrigerant liquid exchanges heat with the air blown by the blower mechanism 4 (the upper blower 4-1 and the lower blower 4-2) and evaporates to become a refrigerant gas. The refrigerant gas returns to the compressor 1 through the four-way valve 2. The above is a cycle of the refrigerant cycle in a case where the air conditioner performs a heating operation.

Figure 2:
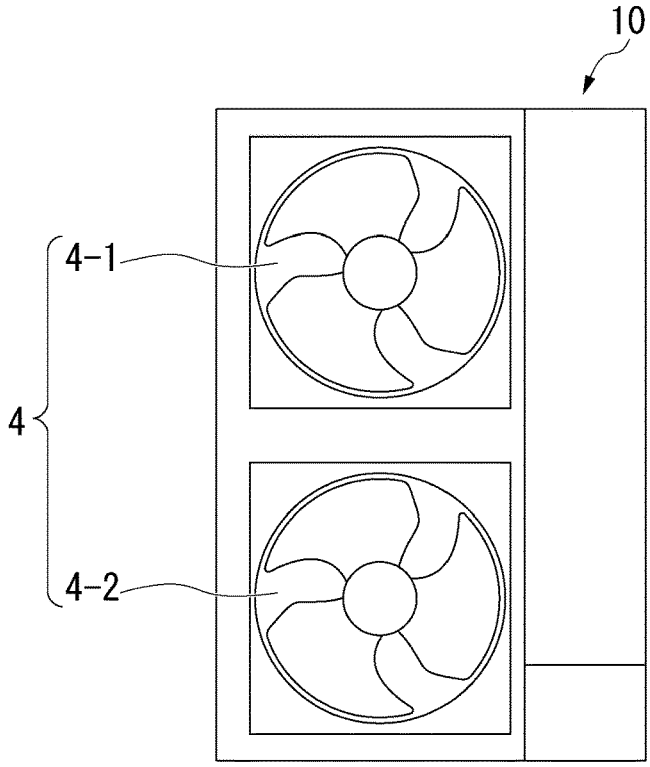
FIG. 2 is a front view showing an outdoor unit according to the first embodiment.
Figure 3:
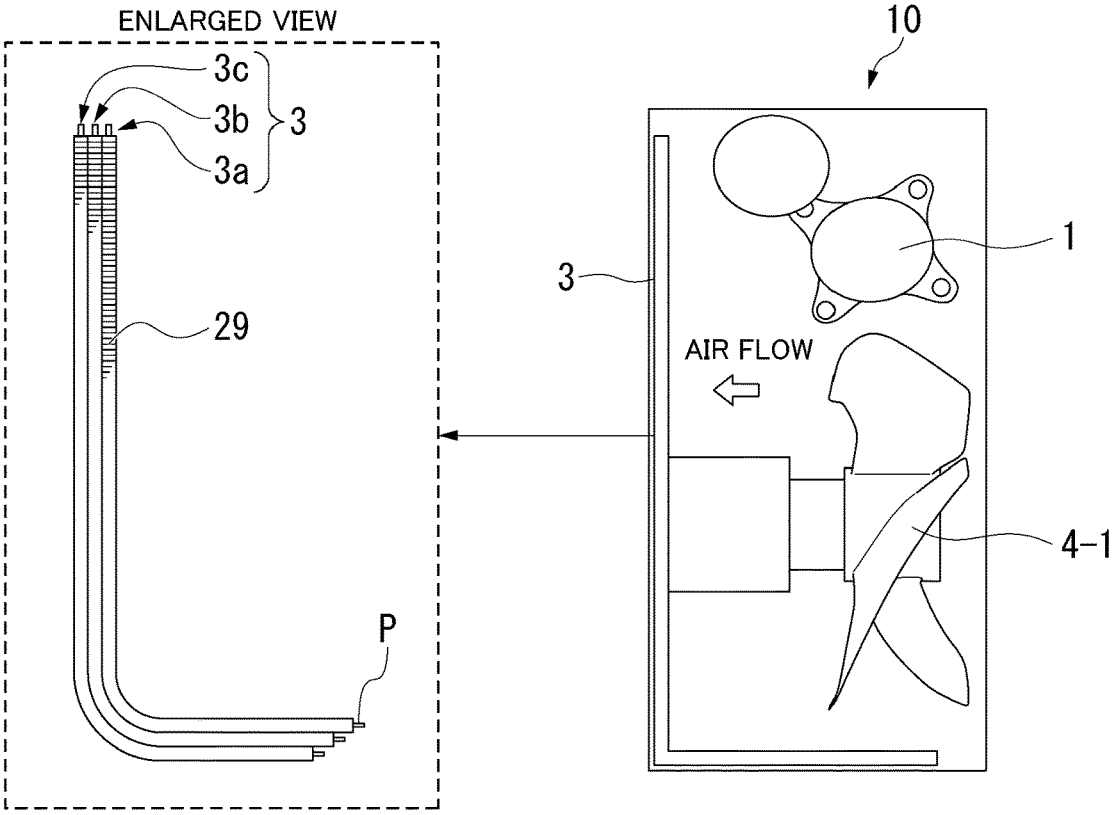
FIG. 3 is a diagram showing main components of the outdoor unit according to the first embodiment.

FIG. 2 is a front view of the outdoor unit 10 according to the first embodiment. The outdoor unit 10 in the present embodiment is of a side flow type. FIG. 3 is a schematic diagram of main components of the outdoor unit 10 according to the first embodiment as viewed from above. The compressor 1 for circulating the refrigerant is disposed adjacent to the upper blower 4-1 in the blower mechanism 4. The blower mechanism 4 is configured to suck the air from outside the outdoor unit 10 and send the air toward the outdoor heat exchanger 3. As shown in FIG. 3, the outdoor heat exchanger 3 is disposed at a position where the outdoor heat exchanger 3 is exposed to the air sent by the blower mechanism 4.

The outdoor heat exchanger 3 is a so-called fin-tube heat exchanger. More specifically, as shown in an enlarged view of FIG. 3, the outdoor heat exchanger 3 has three fin cores 3*a* to 3*c*. Each of the fin cores 3*a* to 3*c* has a plurality of heat transfer pipes P through which refrigerant flows and a plurality of fins 29. The fins 29 exchange heat between the refrigerant flowing through the heat transfer pipes P and the air. The air sent out by the blower mechanism 4 passes through gaps between the fins 29 and is blown out of the outdoor unit 10. Each of the fin cores 3*a*-3*c* has the same configuration. The number of the fin cores included in the outdoor heat exchanger 3 may be changed as appropriate and may be one, two, or four or more.

Figure 4:
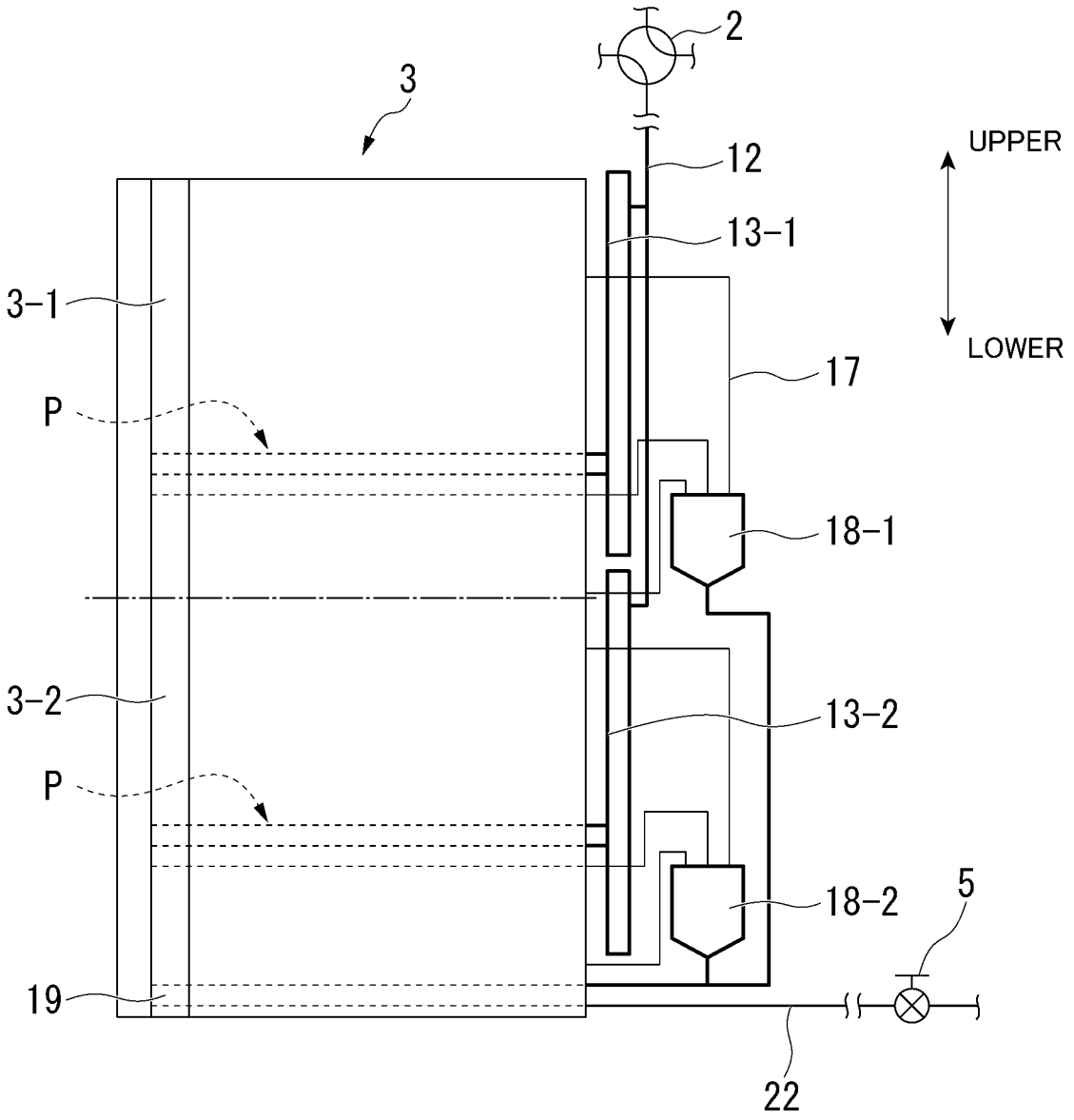
FIG. 4 is a diagram showing main components of an outdoor heat exchanger according to the first embodiment.

FIG. 4 is a schematic diagram showing main components of the outdoor heat exchanger 3 according to the first embodiment. In FIG. 4 and the like, the fins 29 and part of the heat transfer pipes P are omitted to make the drawings easy to see. As shown in FIG. 4, the outdoor heat exchanger 3 according to the first embodiment is divided into two stages (an upper stage 3-1 and a lower stage 3-2) in the vertical direction. A gas header 13-1 and a first flow divider 18-1 are provided corresponding to the upper stage 3-1. A gas header 13-2 and a first flow divider 18-2 are provided corresponding to the lower stage 3-2. The upper stage 3-1 is provided with a plurality of heat transfer pipes P connected in parallel to the gas header 13-1 and the first flow divider 18-1 and arranged side by side in the vertical direction. The lower stage 3-2 is provided with a plurality of heat transfer pipes P connected in parallel to the gas header 13-2 and the first flow divider 18-2 and arranged side by side in the vertical direction.

In the following description, the gas headers 13-1 and 13-2 may be collectively referred to simply as the "gas header 13". Similarly, the first flow dividers 18-1 and 18-2 may be collectively referred to simply as the "first flow divider 18". The gas header 13 is connected to the four-way valve 2 via a first inlet/outlet 12. The gas header 13 is configured to branch and flow the refrigerant toward the plurality of heat transfer pipes P of the outdoor heat exchanger 3. The outdoor heat exchanger 3 does not have to be divided into the upper stage 3-1 and the lower stage 3-2 or may be divided into three or more stages in the vertical direction. Similarly, the number of the gas headers 13 may be one or three or more, and the number of the first flow dividers 18 may be one or three or more.

When the air conditioner performs a cooling operation, the outdoor heat exchanger 3 is used as a condenser, and the high-temperature and high-pressure refrigerant gas flows from the four-way valve 2 toward the gas header 13. The refrigerant gas flows into each heat transfer pipe P of the outdoor heat exchanger 3 through the gas header 13. The refrigerant gas in the heat transfer pipes P exchanges heat with the air via the fins 29 and condenses to become a refrigerant liquid. The plurality of heat transfer pipes P are connected to the first flow divider 18 by a capillary 17. The refrigerant liquid flows through the capillary 17 and the first flow divider 18 into a subcooling heat exchanger 19. More specifically, the refrigerant liquid in the upper stage 3-1 flows through the capillary 17 and the first flow divider 18-1 into the subcooling heat exchanger 19, and the refrigerant liquid in the lower stage 3-2 flows through the capillary 17 and the first flow divider 18-2 into the subcooling heat exchanger 19.

In the subcooling heat exchanger 19, the refrigerant liquid exchanges heat with the air to become a subcooled refrigerant and flows out of the outdoor heat exchanger 3 through a second inlet/outlet 22. As the subcooling heat exchanger 19 produces the subcooled refrigerant, the refrigerant inside a liquid extension pipe provided between the outdoor unit 10 and the indoor system 11 becomes a liquid phase. Thus, it is possible to improve the pressure loss inside a pipe on a high pressure side. Furthermore, the refrigerant at an inlet of the expansion valve 6 of the indoor system 11 is also in the liquid phase, and it is possible to suppress noise generated in the expansion valve 6 when the gas phase and the liquid phase are mixed.

In a case where the air conditioner performs a heating operation, the refrigerant liquid (or a mixture of the refrigerant liquid and the refrigerant gas) condensed in the indoor system 11 flows into the subcooling heat exchanger 19 through the second inlet/outlet 22. A portion of the refrigerant liquid evaporates by exchanging heat in the subcooling heat exchanger 19. The mixture of the refrigerant liquid and the refrigerant gas flows from the subcooling heat exchanger 19 toward the first flow divider 18. The mixture is branched in the first flow divider 18 and flows into each heat transfer pipe P of the outdoor heat exchanger 3 via a plurality of the capillaries 17. The refrigerant liquid contained in the mixture evaporates and becomes the refrigerant gas by exchanging heat with the air via the fins 29 in the heat transfer pipes P. The refrigerant gas passes through the gas header 13 and the first inlet/outlet 12 and flows to the four-way valve 2 outside the outdoor heat exchanger 3.

In a case where the air conditioner performs a heating operation, frost tends to adhere to the fins 29 located on the lowermost side of the outdoor heat exchanger 3. Here, the subcooling heat exchanger 19 is located upstream of the first flow divider 18, and each heat transfer pipe P is located downstream of the first flow divider 18. Therefore, a saturation pressure inside the subcooling heat exchanger 19 is higher than a saturation pressure inside the heat transfer pipes P. That is, a saturation temperature of the refrigerant inside the subcooling heat exchanger 19 becomes higher than a saturation temperature of the refrigerant inside the heat transfer pipes P. Therefore, by locating the subcooling heat exchanger 19 at a lowermost portion of the outdoor heat exchanger 3, it is possible to suppress the adhesion of the frost to lowermost portions of the fins 29. By suppressing the adhesion of the frost to the fins 29, the heating performance of the air conditioner can be improved.

Figure 5:
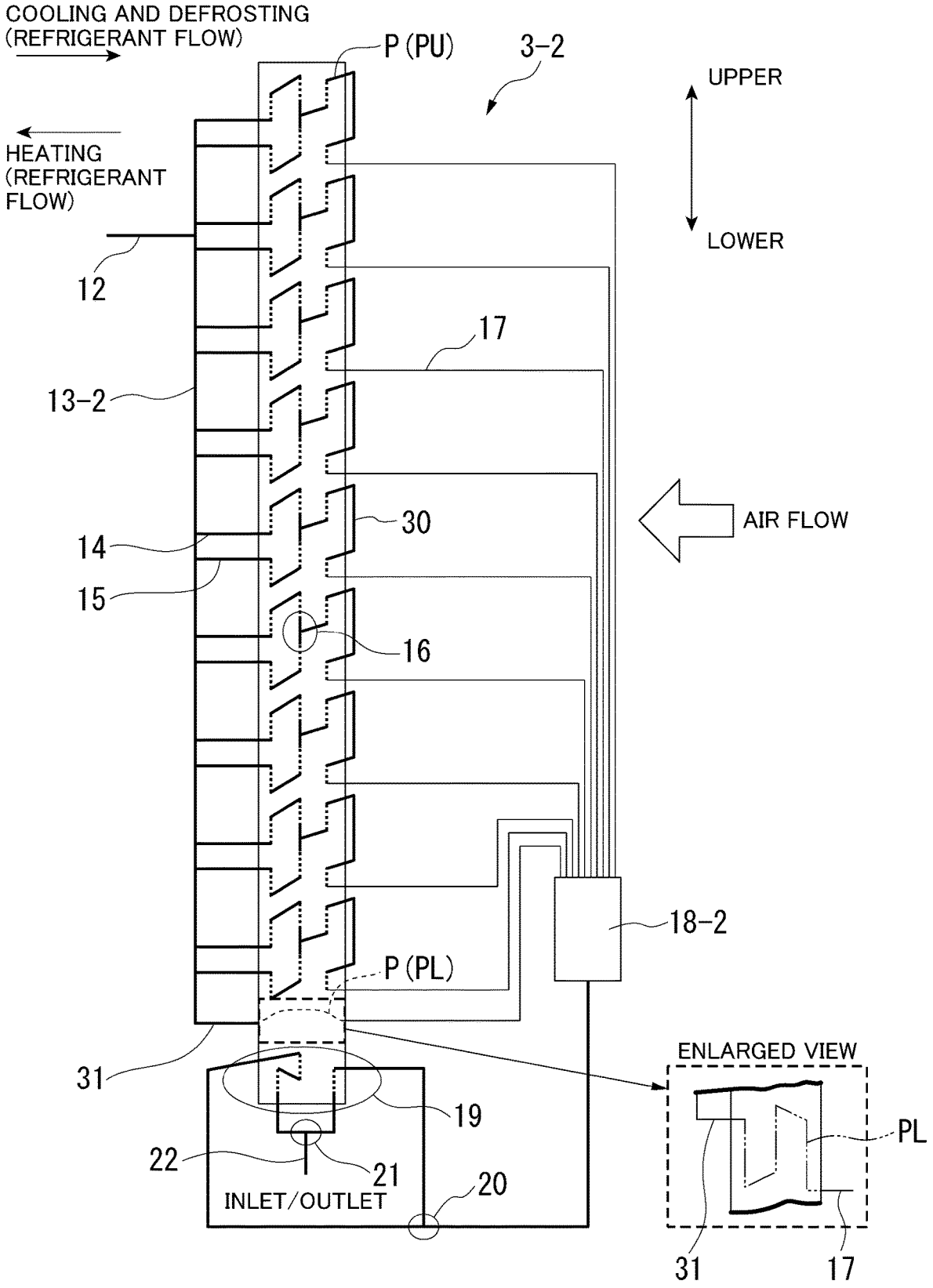
FIG. 5 is a configuration diagram of a refrigerant path in the outdoor heat exchanger according to the first embodiment.

FIG. 5 shows a configuration of a refrigerant path in the lower stage 3-2. An arrow of "air flow" shown in FIG. 5 indicates a direction of the air sent by the blower mechanism 4 (hereinafter simply referred to as an "air flow direction"). As described above, the air flows through the gaps between the fins 29 of the outdoor heat exchanger 3. A plurality of the heat transfer pipes P are disposed at intervals in the vertical direction in the lower stage 3-2. Each heat transfer pipe P is connected to the first flow divider 18-2 by the capillary 17. In the present specification, among the plurality of heat transfer pipes P connected to the gas header 13-2, the heat transfer pipe P located at the lowermost side is referred to as a "lowermost heat transfer pipe PL". Among the plurality of heat transfer pipes P connected to the gas header 13-2, the heat transfer pipe P located above the lowermost heat transfer pipe PL is referred to as an "upper heat transfer pipe PU". In FIG. 5, a total of ten heat transfer pipes P are connected to the gas header 13-2, and the number of the upper heat transfer pipes PU is nine. The number of the upper heat transfer pipes PU may be changed as appropriate and may be one.

The lowermost heat transfer pipe PL is connected to the gas header 13-2 by one single path 31. On the other hand, each upper heat transfer pipe PU is connected to the gas header 13-2 by two branch paths (an upper branch path 14 and a lower branch path 15). Furthermore, each upper heat transfer pipe PU includes a second flow divider 16 that connects the two branch paths 14 and 15 to one merging path 30. Each merging path 30 is connected to an upper end of the first flow divider 18-2 via the capillary 17. In summary, a path of the refrigerant from the gas header 13-2 to the first flow divider 18-2 includes a path passing through the upper heat transfer pipe PU (hereinafter also referred to as a first path) and a path passing through the lowermost heat transfer pipe PL (hereinafter also referred to as a second path). The first path passing through upper heat transfer pipe PU includes the branch paths 14 and 15, the second flow divider 16, the merging path 30, and the capillary 17. In contrast, the second path passing through the lowermost heat transfer pipe PL does not include a branch path and a flow divider.

In the present specification, a length of the flow path from the first flow divider 18-2 to the gas header 13-2 through any second flow divider 16 is denoted by L. As viewed from the first flow divider 18-2, the second flow divider 16 is disposed at a position of about 0.4 to 0.6 L in the flow path.

As shown in FIG. 5, the subcooling heat exchanger 19 is disposed below the lowermost heat transfer pipe PL. The subcooling heat exchanger 19 is connected to a lower end of the first flow divider 18-2. Each heat transfer pipe P is connected to the upper end of the first flow divider 18-2 via the capillary 17.

Here, gravity acts on the refrigerant flowing through the plurality of heat transfer pipes P. In particular, in a case where the outdoor heat exchanger 3 operates as an evaporator (that is, in a case where the air conditioner performs a heating operation), the refrigerant liquid flows into and accumulates in the lowermost heat transfer pipe PL more easily than in the upper heat transfer pipe PU. Such a phenomenon in which the refrigerant flows unevenly into a specific pipe is called "refrigerant drift". The occurrence of the refrigerant drift is a factor that reduces the heat exchange performance (evaporation performance) of the outdoor heat exchanger 3. Therefore, the outdoor heat exchanger 3 according to the present embodiment is configured such that the flow resistance of the refrigerant in each upper heat transfer pipe PU is smaller than the flow resistance of the refrigerant in the lowermost heat transfer pipe PL. More specifically, the lowermost heat transfer pipe PL and gas header 13-2 are connected by the single path 31, and the upper heat transfer pipe PU and the gas header 13-2 are connected by the branch paths 14 and 15. With this configuration, the pressure loss in the lowermost heat transfer pipe PL is greater than the pressure loss in the upper heat transfer pipe PU. Therefore, a flow rate of the refrigerant liquid flowing into the lowermost heat transfer pipe PL located on the lowermost side is suppressed, and the occurrence of refrigerant drift, which tends to occur at a lowermost portion of the outdoor unit 10, can be suppressed. That is, the heat exchange performance (evaporation performance) of the outdoor heat exchanger 3 can be improved.

In a case where the outdoor heat exchanger 3 operates as a condenser (that is, in a case where the air conditioner performs a cooling operation), the refrigerant gas discharged from the compressor 1 flows into the plurality of heat transfer pipes P through the first inlet/outlet 12 and the gas header 13 and condenses in the plurality of heat transfer pipes P. In the flow paths between the branch paths 14, 15 and the second flow divider 16, the refrigerant in a liquid phase and the refrigerant in a gas phase may be in a mixed state. The condensation of the refrigerant progresses further while the refrigerant merges at the second flow divider 16 and passes through the merging path 30. Thereafter, the refrigerant passes through the first flow divider 18 and the subcooling heat exchanger 19, so that the refrigerant becomes a substantially liquid state (or in a subcooled state) and flows into the indoor system 11.

As described above, the outdoor heat exchanger 3 according to the present embodiment includes the plurality of fins 29 disposed at intervals, the blower mechanism 4 that blows the air into the gaps between the fins 29, and the plurality of heat transfer pipes P which are arranged side by side in a vertical direction intersecting a direction in which the air flows and through which the refrigerant that exchanges heat with the air via the plurality of fins 29 flows, and the first flow divider 18 connected to the plurality of heat transfer pipes P. The plurality of heat transfer pipes P includes the lowermost heat transfer pipe PL and at least one upper heat transfer pipe PU located above the lowermost heat transfer pipe PL. The upper heat transfer pipe PU includes the merging path 30 connected to the first flow divider 18, the second flow divider 16 provided at an end portion of the merging path 30, and at least two branch paths 14 and 15 branched from the second flow divider 16. The flow resistance of the refrigerant in a liquid phase inside the upper heat transfer pipe PU is smaller than the flow resistance of the refrigerant in a liquid phase inside the lowermost heat transfer pipe PL.

According to this configuration, the pressure loss of the refrigerant inside the lowermost heat transfer pipe PL is greater than the pressure loss of the refrigerant inside the upper heat transfer pipe PU. Therefore, it is possible to suppress the occurrence of the refrigerant drift toward the lowermost heat transfer pipe PL among the plurality of heat transfer pipes P. In addition, according to a structure in which the second flow divider 16 is provided in the upper heat transfer pipe PU, it is possible to improve the pressure loss in an entirety of the outdoor heat exchanger 3, compared to a structure in which the refrigerant path located on the lowermost side is simply lengthened as in the related art. That is, the evaporation performance of the outdoor heat exchanger 3 can be improved more than the related art.

Further, the outdoor heat exchanger 3 according to the present embodiment includes the gas header 13 to which the plurality of heat transfer pipes P are connected in parallel. When the length of the flow path from the first flow divider 18 to the gas header 13 through the second flow divider 16 is denoted by L, the second flow divider 16 is provided at a position of about 0.4 L to 0.6 L in the flow path when viewed from the first flow divider 18.

Although details will be described later, according to this configuration, it is possible to increase a range in which dryness inside the pipe is high and utilize high heat transfer performance. That is, the condensation performance of the outdoor heat exchanger 3 can be improved.

Further, the air conditioner according to the present embodiment includes the outdoor unit 10 and the indoor system 11, and the outdoor unit 10 includes the outdoor heat exchanger 3, the compressor 1, and the four-way valve 2. The air conditioner performs a heating operation when the outdoor heat exchanger 3 operates as an evaporator, and performs a cooling operation when the outdoor heat exchanger 3 operates as a condenser. As described above, by improving the heat exchange performance of the outdoor heat exchanger 3, it is possible to provide an air conditioner with improved heating performance or cooling performance.

Figure 6A:
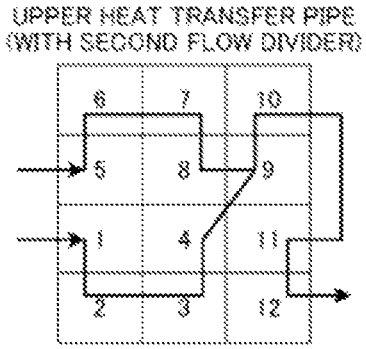
FIGS. 6A to 6D are diagrams showing condensation performance of the outdoor heat exchanger according to the first embodiment.
Figure 6B:
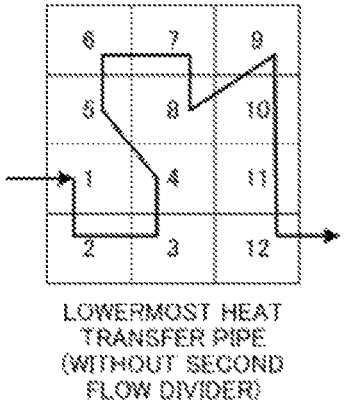

FIGS. 6A to 6D are diagrams showing that the outdoor heat exchanger 3 according to the first embodiment improves the heat exchange performance. FIG. 6A is a diagram schematically showing the flow of refrigerant in the upper heat transfer pipe PU, and FIG. 6B is a diagram schematically showing the flow of refrigerant in the lowermost heat transfer pipe PL. As described above, the upper heat transfer pipe PU includes the second flow divider 16 that merges the upper branch path 14 and the lower branch path 15 and connects them to one merging path 30. In FIG. 6A, blocks 5 to 8 correspond to the path of the refrigerant passing through the upper branch path 14, and blocks 1 to 4 correspond to the path of the refrigerant passing through the lower branch path 15. In FIG. 6A, a block 9 corresponds to the second flow divider 16, and blocks 10 to 12 correspond to the path of the refrigerant passing through the merging path 30. FIG. 6B shows how the refrigerant flows in series through the blocks 1 to 12 corresponding to one single path 31 connected to the capillary 17 without branching in the lowermost heat transfer pipe PL.

Figure 6C:
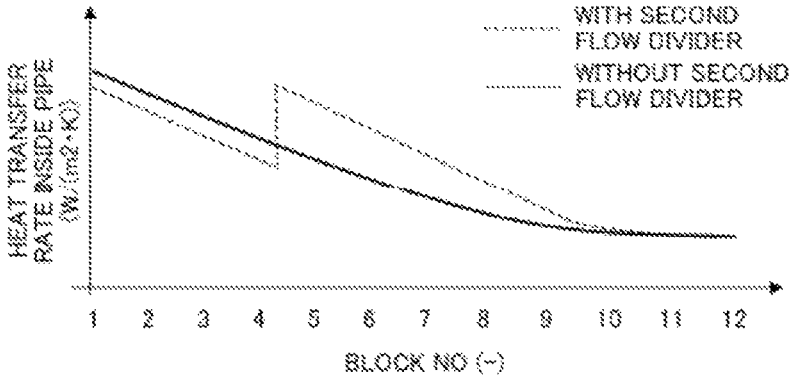
Figure 6D:
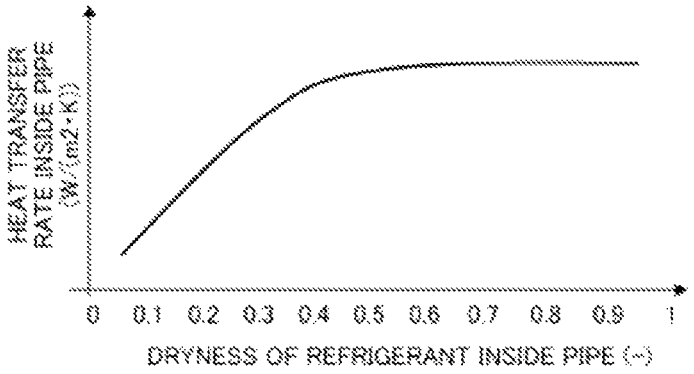

A graph of "with second flow divider" in FIG. 6C corresponds to the upper heat transfer pipe PU (FIG. 6A). A graph of "without second flow divider" in FIG. 6C corresponds to the lowermost heat transfer pipe PL (FIG. 6B). A horizontal axis in FIG. 6C corresponds to each block in FIGS. 6A and 6B, and a vertical axis represents a heat transfer rate inside the pipe in each block. A graph of FIG. 6D represents a relationship between the dryness of the refrigerant gas inside the pipe (horizontal axis) and the heat transfer rate inside the pipe (vertical axis). As the condensation of the refrigerant gas progresses inside the pipe, the dryness inside the pipe decreases, and the amount of the refrigerant liquid inside the pipe increases. As the amount of the refrigerant liquid inside the pipe increases, a surface area inside the pipe available for condensation of the refrigerant gas is reduced so that the heat transfer rate decreases. Therefore, as shown in FIG. 6D, the heat transfer rate tends to decrease as the dryness decreases. In particular, when the dryness is less than 0.4, the heat transfer rate decreases significantly. As shown in FIG. 6C, the heat transfer rates of blocks 5 to 8 are small in a case of "without second flow divider". This is because the blocks 1 to 4 and the blocks 5 to 8 are connected in series, and the condensation of the refrigerant gas progresses in the blocks 5 to 8 on the downstream side, resulting in a decrease in dryness. On the other hand, in a case of "with second flow divider", since the blocks 1 to 4 and the blocks 5 to 8 are connected in parallel, the condensation of the refrigerant gas in the blocks 5 to 8 is not progressing compared to a case of "without second flow divider". Therefore, in the configuration "with the second flow divider", the dryness inside the pipe can be made high in a wider range. As described above, in the upper heat transfer pipe PU having the second flow divider 16, high heat transfer performance with a dryness in a range of 0.4 to 1.0 can be utilized. That is, it is possible to improve the condensation performance of the outdoor heat exchanger 3.

Further, when the length of the flow path from the first flow divider 18 to the gas header 13 through the second flow divider 16 is denoted by L, it is preferable that the second flow divider 16 is provided at a position of about 0.4 L to 0.6 L in the flow path when viewed from the first flow divider 18. According to this configuration, it is possible to increase a proportion of the flow path with a dryness of 0.4 to 1.0.

Second Embodiment

Next, the outdoor heat exchanger 3 according to a second embodiment will be described. A basic configuration of the second embodiment is the same as that of the first embodiment. For this reason, similar configurations are given the same reference signs, descriptions thereof are omitted, and characteristic points of the present embodiment will be described.

Figure 7:
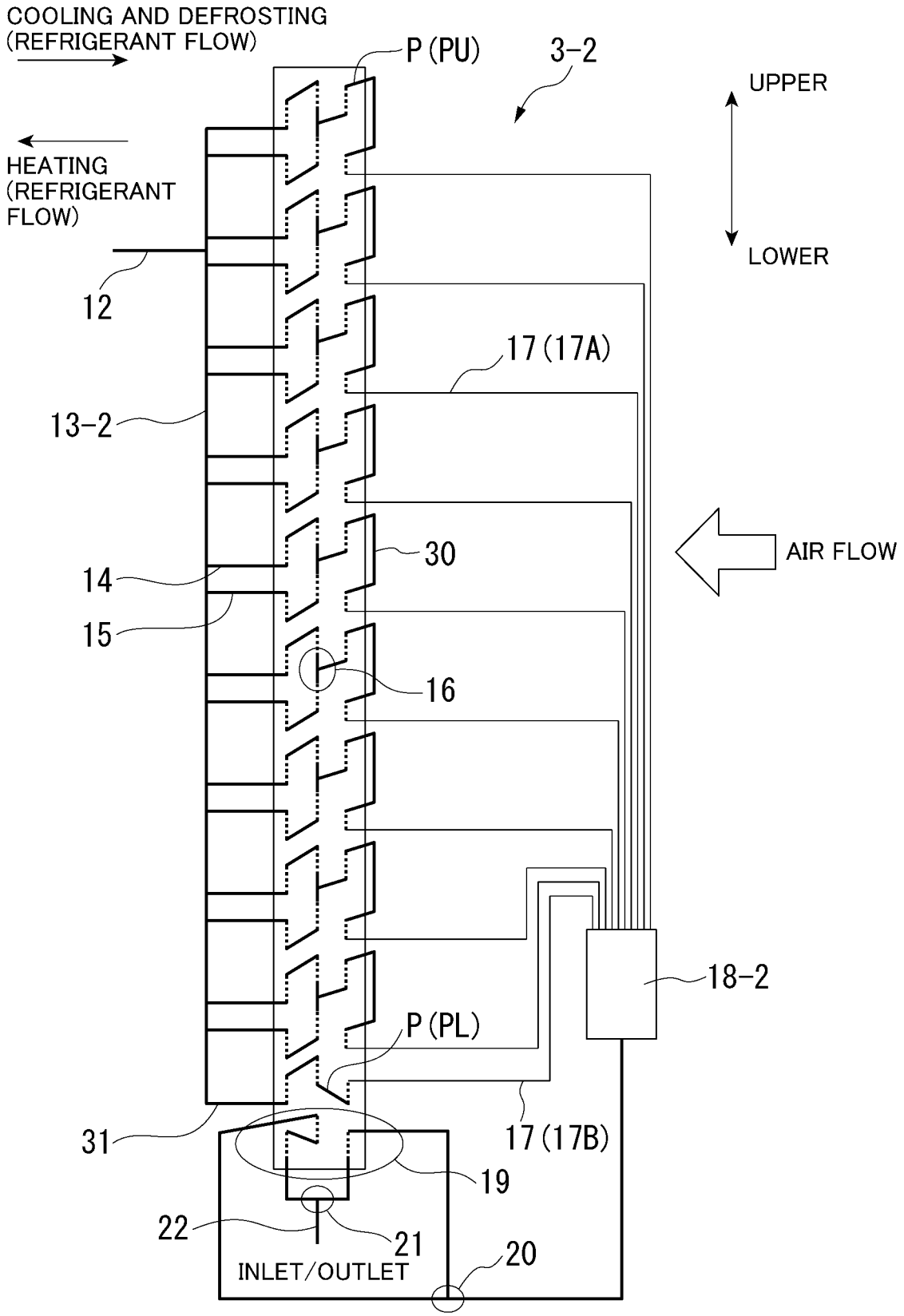
FIG. 7 is a configuration diagram of a refrigerant path in an outdoor heat exchanger according to a second embodiment.

FIG. 7 is a configuration diagram of the refrigerant path in the lower stage 3-2 of the outdoor heat exchanger 3 according to the second embodiment. As shown in FIG. 7, the capillary 17 connecting the upper heat transfer pipe PU and the first flow divider 18-2 is particularly referred to as an "upper capillary 17A". The capillary 17 connecting the lowermost heat transfer pipe PL and the first flow divider 18-2 is particularly referred to as a "lowermost capillary 17B".

The outdoor heat exchanger 3 according to the present embodiment is configured such that the flow resistance of the refrigerant liquid inside the lowermost capillary 17B is greater than the flow resistance of the refrigerant liquid inside the upper capillary 17A. That is, the pressure loss of the refrigerant liquid in the lowermost capillary 17B becomes larger than the pressure loss of the refrigerant liquid in the upper capillary 17A.

In the present embodiment, the flow path length of the refrigerant from the first flow divider 18-2 to the gas header 13-2 through the lowermost capillary 17B, the lowermost heat transfer pipe PL, and the single path 31 is referred to as a "first flow path length". Further, the flow path length of the refrigerant from the first flow divider 18-2 to the gas header 13-2 through the upper capillary 17A, the upper heat transfer pipe PU, and the branch path 14 or 15 is referred to as a "second flow path length". The first flow path length is shorter than the second flow path length.

As described above, in the outdoor heat exchanger 3 according to the present embodiment, the flow resistance of the refrigerant in a liquid phase inside the capillary 17B connecting the lowermost heat transfer pipe PL and the first flow divider 18 is greater than the flow resistance of the refrigerant in a liquid phase inside the capillary 17A connecting the upper heat transfer pipe PU and the first flow divider 18. According to this configuration, it becomes the refrigerant is less likely to flow into the lowermost heat transfer pipe PL, and the occurrence of the refrigerant drift can be suppressed more reliably.

Further, the outdoor heat exchanger 3 according to the present embodiment includes the gas header 13 to which the plurality of heat transfer pipes P are connected in parallel. The first flow path length from the first flow divider 18 to the gas header 13 through the lowermost heat transfer pipe PL is shorter than the second flow path length from the first flow divider 18 to the gas header 13 through the upper heat transfer pipe PU. According to this configuration, it is possible to reduce the pressure loss of the refrigerant in the lowermost heat transfer pipe PL. Therefore, the pressure loss in an entirety of the outdoor heat exchanger 3 can be reduced, and the evaporation performance and condensation performance of the outdoor heat exchanger 3 can be improved.

Third Embodiment

Next, the outdoor heat exchanger 3 according to a third embodiment will be described. A basic configuration of the second embodiment is the same as that of the first embodiment. For this reason, similar configurations are given the same reference signs, descriptions thereof are omitted, and characteristic points of the present embodiment will be described.

Figure 8:
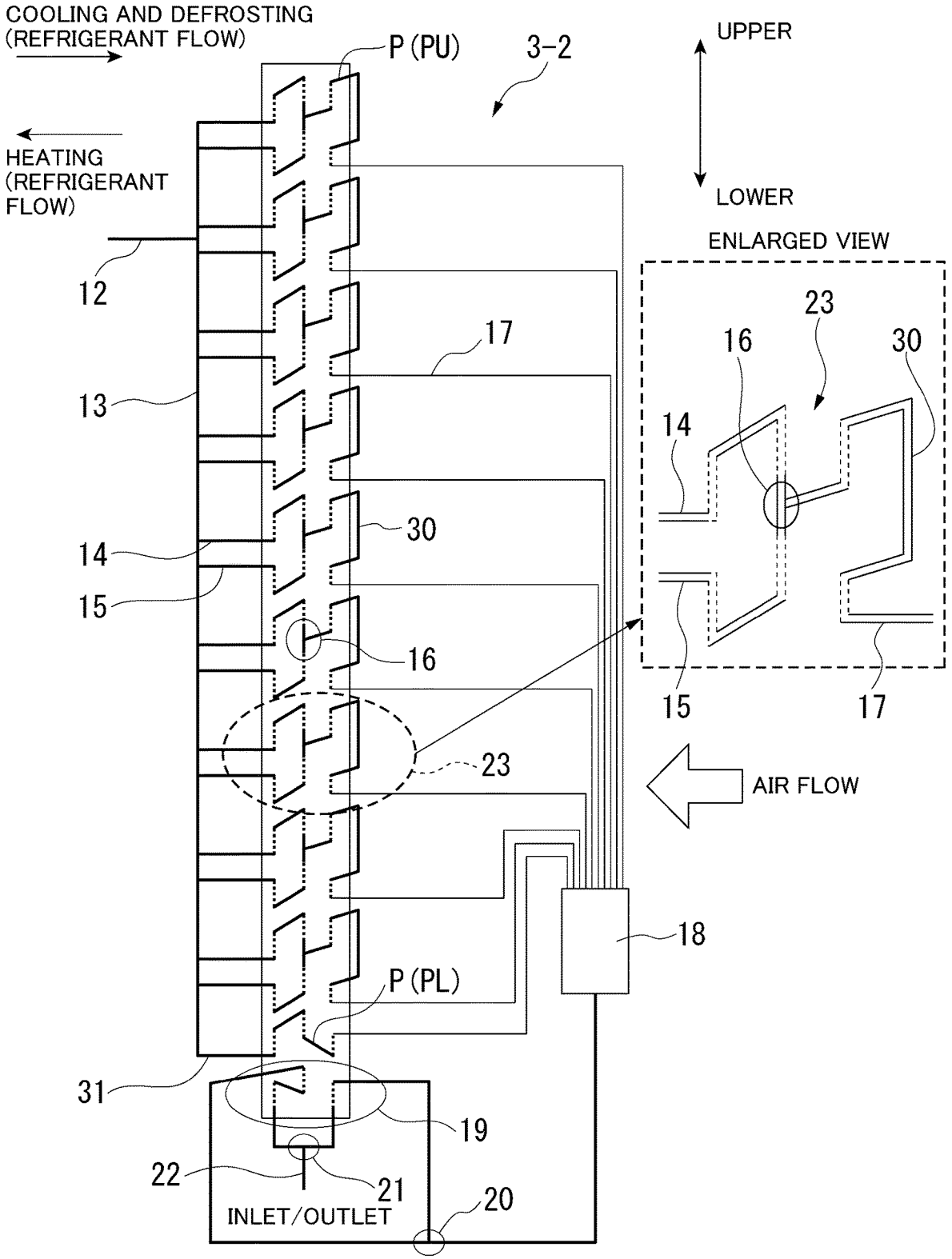
FIG. 8 is a configuration diagram of a refrigerant path in an outdoor heat exchanger according to a third embodiment.

FIG. 8 is a configuration diagram of the refrigerant path in the outdoor heat exchanger 3 according to the third embodiment. As shown in FIG. 8, in the present embodiment, a flow path including the branch paths 14 and 15, the second flow divider 16, and the merging path 30 is referred to as a "refrigerant path 23". In the refrigerant path 23, both an inner diameter of the upper branch path 14 and an inner diameter of the lower branch path 15 are smaller than an inner diameter of the merging path 30. According to this configuration, a flow velocity of the refrigerant liquid inside the branch paths 14 and 15 can be increased, and the heat transfer rate can be increased. Therefore, it is possible to improve the performance of the outdoor heat exchanger 3.

Fourth Embodiment

Next, the outdoor heat exchanger 3 according to a fourth embodiment will be described. A basic configuration of the fourth embodiment is the same as that of the third embodiment. For this reason, similar configurations are given the same reference signs, descriptions thereof are omitted, and characteristic points of the present embodiment will be described.

Figure 9:
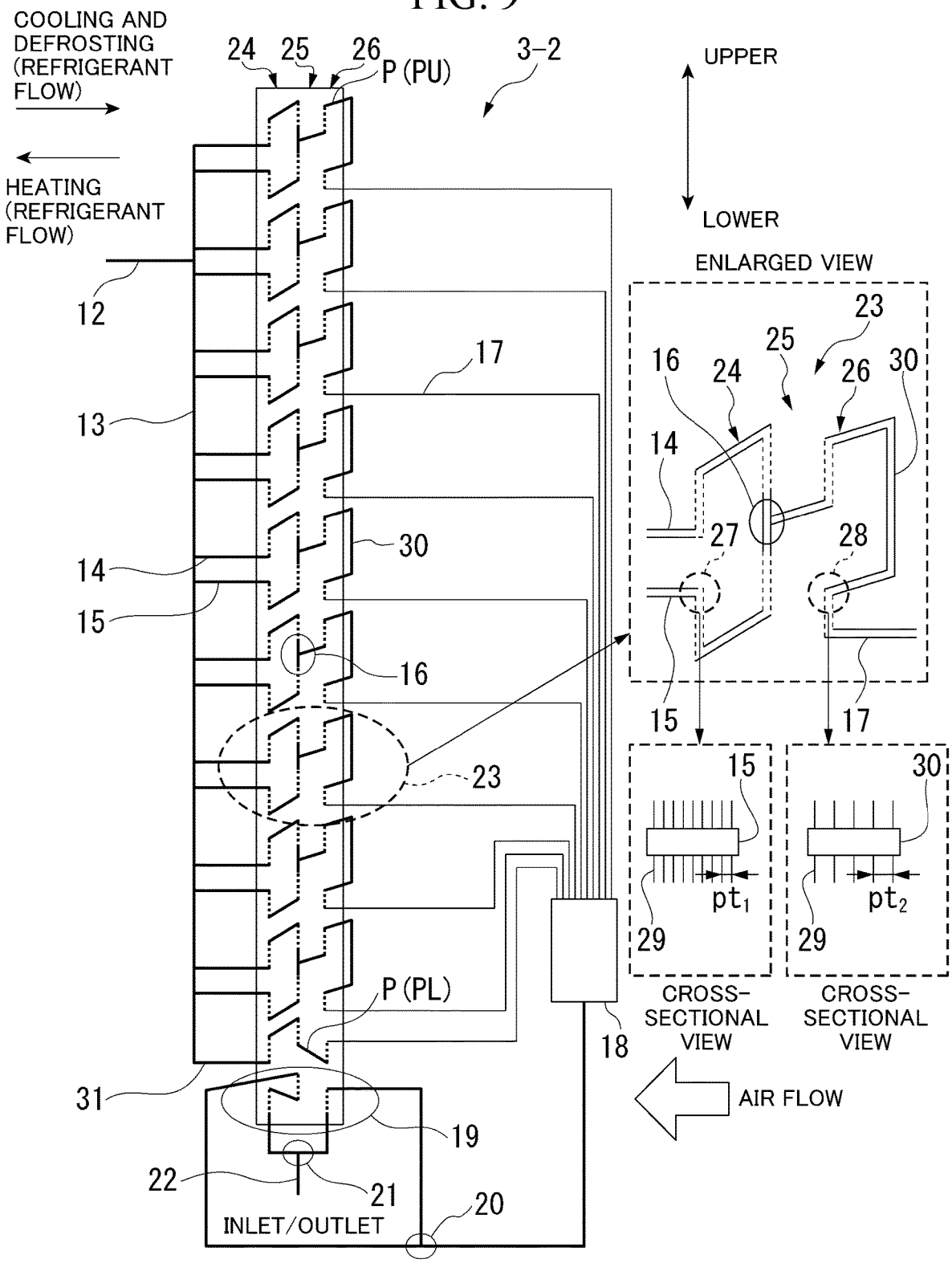
FIG. 9 is a configuration diagram of a refrigerant path in an outdoor heat exchanger according to a fourth embodiment.

FIG. 9 is a configuration diagram of the refrigerant path in the outdoor heat exchanger 3 according to the fourth embodiment. The outdoor heat exchanger 3 is partitioned into three rows (a first row 26, a second row 25, and a third row 24) in an air flow direction. The first row 26 is located furthest upstream in the air flow direction, and the third row 24 is located furthest downstream in the air flow direction. The second row 25 is located between the first row 26 and the third row 24. The merging path 30 is located in the first row 26, the second flow divider 16 is located in the second row 25, and the branch paths 14 and 15 are located in the third row 24.

As shown in a cross-sectional view corresponding to reference sign 27 in FIG. 9, a fin pitch $pt_1$ is an interval between the fins 29 in the third row 24. The interval between the fins 29 in the second row 25 may be the same as the fin pitch $pt_1$. As shown in a cross-sectional view corresponding to reference sign 28 in FIG. 9, a fin pitch $pt_2$ is an interval between the fins 29 in the first row 26. In other words, the interval between the fins 29 contacting the upper branch path 14 or the lower branch path 15 is the fin pitch $pt_1$, and the interval between the fins 29 contacting the merging path 30 is the fin pitch $pt_2$. The fin pitch $pt_1$ is smaller than the fin pitch $pt_2$.

Further, as described in the third embodiment, both the inner diameter of the upper branch path 14 and the inner diameter of the lower branch path 15 are smaller than the inner diameter of the merging path 30. Therefore, a height of a burr formed on the fins 29 through which flow path pipes of the branch paths 14 and 15 are inserted is smaller than a height of a burr formed on the fins 29 through which a flow path pipe of the merging path 30 is inserted. The burr protrudes in a direction in which the plurality of fins 29 are arranged from opening edges of through holes formed in the fins 29 for passing each flow path pipe. The lower the height of the burr, the smaller the fin pitch. Therefore, as shown in FIG. 9, the fin pitch $pt_1$ can be made smaller than the fin pitch $pt_2$.

Thus, in the outdoor heat exchanger 3 according to the present embodiment, the interval ($pt_1$) between the fins 29 provided on the two branch paths 14 and 15 is less than the interval ($pt_2$) between the fins 29 provided on the merging path 30. According to this configuration, the number of the fins 29 in the outdoor heat exchanger 3 is increased. Therefore, the area for heat exchange with the air increases, and it is possible to improve the heat exchange performance of the outdoor heat exchanger 3.

Fifth Embodiment

Next, the outdoor heat exchanger 3 according to a fifth embodiment will be described. A basic configuration of the fifth embodiment is the same as that of the third embodiment. For this reason, similar configurations are given the same reference signs, descriptions thereof are omitted, and characteristic points of the present embodiment will be described.

Figure 10:
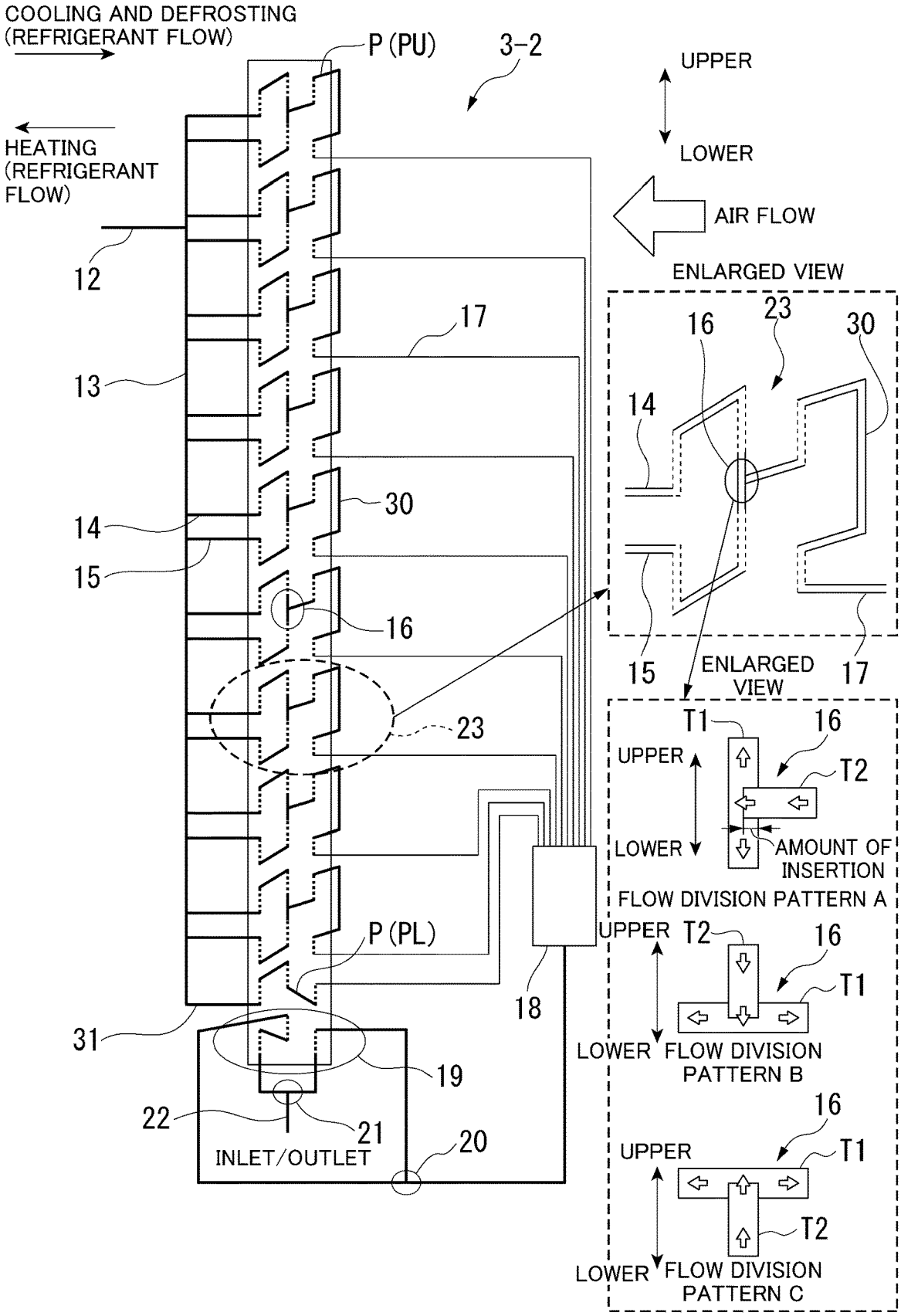
FIG. 10 is a configuration diagram of a refrigerant path in an outdoor heat exchanger according to a fifth embodiment.

FIG. 10 is a configuration diagram of the refrigerant path in the outdoor heat exchanger 3 according to the fifth embodiment. As shown in FIG. 10, in the fifth embodiment, a plurality of structural examples (flow division patterns A to C) of the second flow divider 16 are proposed. In the following description, a pipe connecting end portions of the branch paths 14 and 15 included in the second flow divider 16 is referred to as a branch pipe T1. A pipe located at the end portion of the merging path 30 and included in the second flow divider 16 is referred to as a merging pipe T2. In the present embodiment, the second flow divider 16 is formed by inserting the merging pipe T2 into the branch pipe T1.

In the flow division pattern A, the branch pipe T1 extends in a vertical direction, and the merging pipe T2 extends in a direction (horizontal direction) perpendicular to the vertical direction. In the flow division pattern B and the flow division pattern C, the branch pipe T1 extends in a horizontal direction, and the merging pipe T2 extends in a vertical direction. In the flow division pattern B, the merging pipe T2 is inserted into the branch pipe T1 from above, and in the flow division pattern C, the merging pipe T2 is inserted into the branch pipe T1 from below. In a case of the flow division pattern A, the amount of the refrigerant flowing toward the lower branch path 15 tends to be larger than that toward the upper branch path 14 due to the influence of gravity. Therefore, it is preferable to set the amount of insertion of the merging pipe T2 into the branch pipe T1 such that the refrigerant flowing out of the merging pipe T2 collides with an inner wall of the branch pipe T1. Thus, a branching property of the refrigerant in the second flow divider 16 is improved. Also, in the flow division patterns B and C, the amount of insertion of the merging pipe T2 into the branch pipe T1 may be set such that the refrigerant flowing out of the merging pipe T2 collides with the inner wall of the branch pipe T1.

As described above, in the outdoor heat exchanger 3 according to the flow division pattern A in the present embodiment, the second flow divider 16 is formed by inserting the merging pipe T2 located at the end portion of the merging path 30 into the branch pipe T1 connecting the end portions of the two branch paths 14 and 15. Further, the second flow divider 16 is configured such that the branch pipe T1 extends in a vertical direction, and the refrigerant flowing out of the merging pipe T2 collides with the inner wall of the branch pipe T1. According to this configuration, the branching property of the refrigerant in the second flow divider 16 is improved, and the refrigerant flows into the branch paths 14 and 15 more evenly. Therefore, it is possible to improve the evaporation performance of the outdoor heat exchanger 3 and the heating performance of the air conditioner.

Further, in the outdoor heat exchangers 3 according to the flow division patterns B and C in the present embodiment, the second flow divider 16 is formed by connecting the merging pipe T2 located at the end portion of the merging path 30 to the branch pipe T1 connecting the end portions of the two branch paths 14. Furthermore, the branch pipe T1 extends in a horizontal direction. According to this configuration, unevenness in the amount of the refrigerant flowing into the branch paths 14 and 15 due to the influence of gravity is suppressed. As a result, the branching property of the refrigerant in the second flow divider 16 is improved, and the refrigerant flows into the branch paths 14 and 15 more evenly. Therefore, it is possible to improve the evaporation performance of the outdoor heat exchanger 3 and the heating performance of the air conditioner.

In addition, in the flow division patterns B and C, the merging pipe T2 does not have to be inserted into the branch pipe T1. If a configuration is made such that the merging pipe T2 is connected to the branch pipe T1 and the refrigerant does not leak, this configuration can function as the second flow divider 16.

Sixth Embodiment

Next, the outdoor heat exchanger 3 according to a sixth embodiment will be described. The sixth embodiment has the same basic configuration as the outdoor heat exchanger 3 adopting the flow division pattern A in the fifth embodiment. For this reason, similar configurations are given the same reference signs, descriptions thereof are omitted, and characteristic points of the present embodiment will be described.

Figure 11:
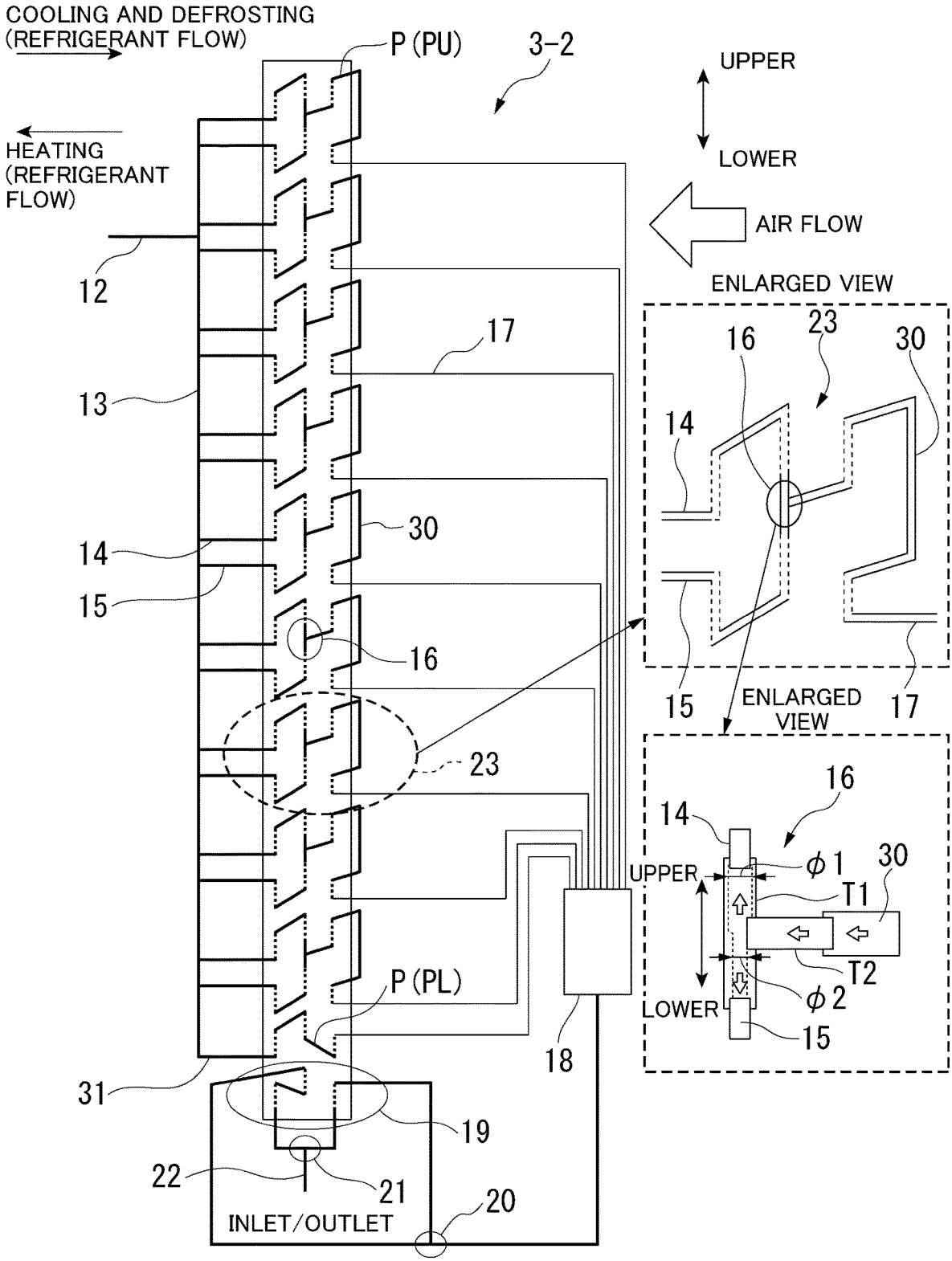
FIG. 11 is a configuration diagram of a refrigerant path in an outdoor heat exchanger according to a sixth embodiment.

FIG. 11 is a configuration diagram of the refrigerant path in the outdoor heat exchanger 3 according to the sixth embodiment. In the present embodiment, an inner diameter at an upper end (an end portion connected to the upper branch path 14) of the branch pipe T1 is represented by a first inner diameter φ1, and an inner diameter at a lower end (an end portion connected to the lower branch path 15) of the branch pipe T1 is represented by a second inner diameter φ2.

In a case where the branch pipe T1 extends in a vertical direction, the refrigerant is more likely to flow toward the lower branch path 15 than toward the upper branch path 14 due to the influence of gravity. Therefore, in the present embodiment, as shown in FIG. 11, a configuration is proposed in which the first inner diameter φ1 is larger than the second inner diameter φ2. With this configuration, it is possible to reduce the amount of the refrigerant flowing into the lower branch path 15.

As described above, in the outdoor heat exchanger 3 according to the present embodiment, the second flow divider 16 is formed by connecting the merging pipe T2 located at the end portion of the merging path 30 to the branch pipe T1 connecting the end portions of the two branch paths 14. The branch pipe T1 extends in a vertical direction, and the first inner diameter φ1 at the upper end of the branch pipe T1 is larger than the second inner diameter φ2 at the lower end of the branch pipe T1. According to this configuration, it is possible to suppress an increase in the amount of the refrigerant flowing into the lower branch path 15 due to the influence of gravity. That is, the refrigerant can flow into each of the branch paths 14 and 15 more evenly. Therefore, it is possible to improve the evaporation performance of the outdoor heat exchanger 3 and the heating performance of the air conditioner.

Seventh Embodiment

Next, the outdoor heat exchanger 3 according to the seventh embodiment will be described. A basic configuration of the seventh embodiment is the same as that of the third embodiment. For this reason, similar configurations are given the same reference signs, descriptions thereof are omitted, and characteristic points of the present embodiment will be described.

Figure 12:
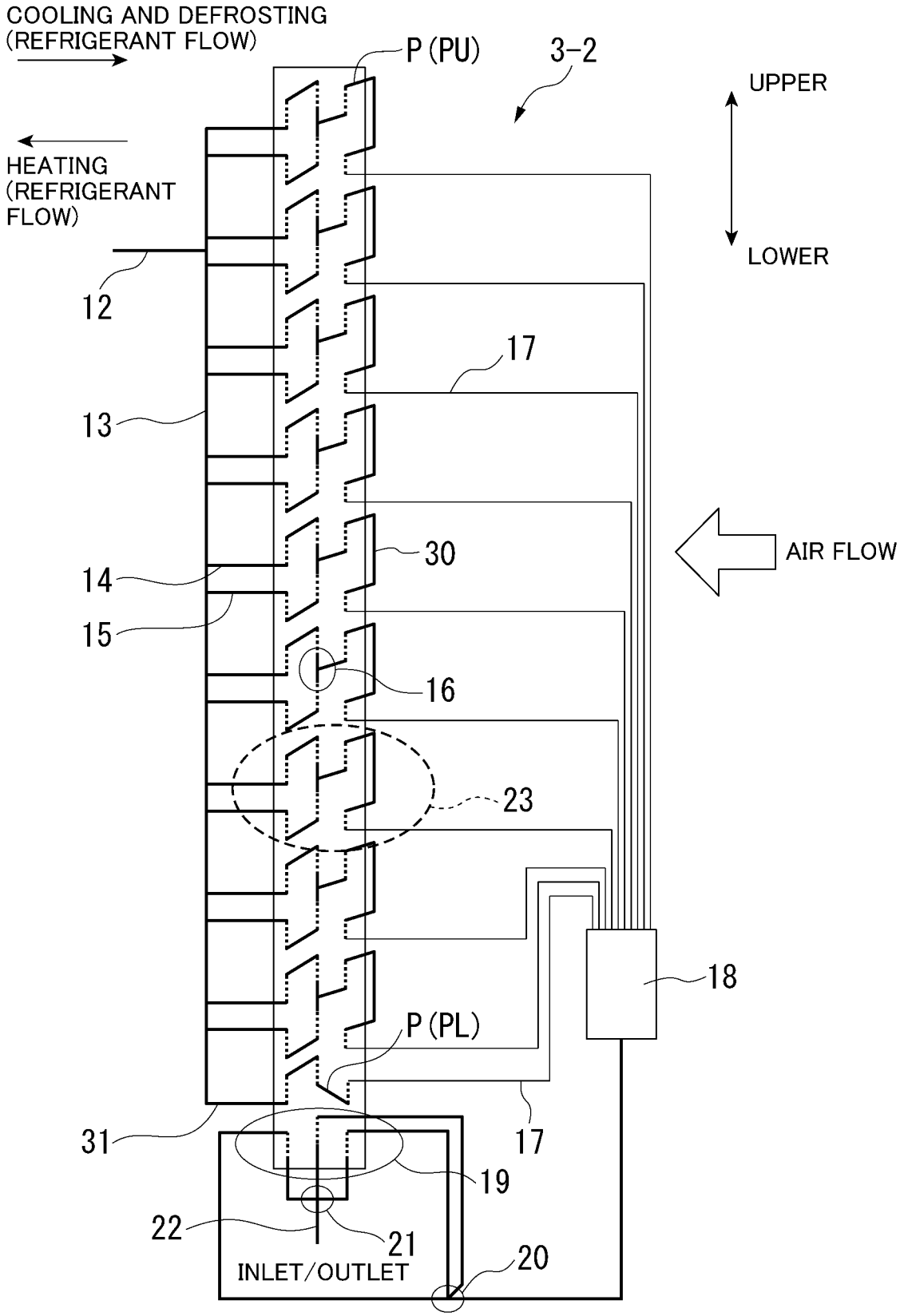
FIG. 12 is a configuration diagram of a refrigerant path in an outdoor heat exchanger according to a seventh embodiment.

FIG. 12 is a configuration diagram of the refrigerant path in the outdoor heat exchanger 3 according to the seventh embodiment. In the present embodiment, a third flow divider 20 and a fourth flow divider 21 are connected to the subcooling heat exchanger 19. The third flow divider 20 branches the refrigerant path from the first flow divider 18 to the subcooling heat exchanger 19 into three. The fourth flow divider 21 merges the three branched refrigerant paths of the subcooling heat exchanger 19 into one refrigerant path and connects the merged refrigerant path to the second inlet/outlet 22. Although the outdoor heat exchanger 3 according to the present embodiment includes both the third flow divider 20 and the fourth flow divider 21, the outdoor heat exchanger 3 may include only one of the third flow divider 20 and the fourth flow divider 21.

As described above, in the outdoor heat exchanger 3 according to the seventh embodiment, the subcooling heat exchanger 19 includes a plurality of refrigerant paths, and the flow divider (one or both of the third flow divider 20 and the fourth flow divider 21) merging the plurality of refrigerant paths into one refrigerant path is connected to the subcooling heat exchanger 19. With this configuration, the pressure loss in the subcooling heat exchanger 19 of the outdoor heat exchanger 3 can be reduced. That is, it is possible to improve the heat exchange performance of the outdoor heat exchanger 3 or the cooling and heating performance of the air conditioner.

The outdoor heat exchangers 3 according to some embodiments have been described above. However, the technical scope of the present disclosure is not limited to the above embodiments, and various modifications can be made without departing from the gist of the present disclosure.

For example, in the above embodiments, the number of the branch paths connected to one second flow divider 16 was two (the upper branch path 14 and the lower branch path 15). However, three or more branch paths may be connected to one second flow divider 16.

Further, in the above-described embodiments, the second flow dividers 16 are provided in all the upper heat transfer pipes PU, but the second flow dividers 16 may be provided only in some of the upper heat transfer pipes PU.

Although the outdoor heat exchanger 3 includes a plurality of the upper heat transfer pipes PU, at least one upper heat transfer pipe PU is sufficient.

Further, in the above embodiments, the structure of the refrigerant path in the lower stage 3-2 has been mainly described, but the structure of the upper stage 3-1 may be the same as that of the lower stage 3-2.

In addition, it is possible to appropriately replace the components in the above-described embodiments with known components without departing from the scope of the present disclosure, and the above-described embodiments and modifications may be combined as appropriate.

For example, two or more of the three types of the flow division patterns A to C shown in FIG. 10 may be employed for the same outdoor heat exchanger 3.

The invention claimed is:

1. An outdoor heat exchanger comprising:

a plurality of fins that are disposed at intervals;

a blower mechanism that blows air into gaps between the fins;

a plurality of heat transfer pipes which are arranged side by side in a vertical direction that intersects a direction in which the air flows, and through which a refrigerant that exchanges heat with the air via the plurality of fins flows;

a first flow divider connected to the plurality of heat transfer pipes; and a gas header to which the plurality of heat transfer pipes are connected in parallel, wherein the plurality of heat transfer pipes is connected between the first flow divider and the gas header, the plurality of heat transfer pipes includes a lowermost heat transfer pipe located on a lowermost side and an upper heat transfer pipe located above the lowermost heat transfer pipe, the upper heat transfer pipe includes a merging path connected to the first flow divider, a second flow divider provided at an end portion of the merging path, and two branch paths branched from the second flow divider, the two branch paths are connected to the gas header, the lowermost heat transfer pipe is connected to the gas header by a single path, and a flow resistance of the refrigerant in a liquid phase inside the upper heat transfer pipe is smaller than a flow resistance of the refrigerant in a liquid phase inside the lowermost heat transfer pipe.

2. The outdoor heat exchanger according to claim 1, wherein a flow resistance of the refrigerant in a liquid phase inside a capillary connecting the lowermost heat transfer pipe and the first flow divider is greater than a flow resistance of the refrigerant in a liquid phase inside a capillary connecting the upper heat transfer pipe and the first flow divider.

3. The outdoor heat exchanger according to claim 1, wherein a flow path length of the refrigerant from the first flow divider to the gas header through the lowermost heat transfer pipe is shorter than a flow path length of the refrigerant from the first flow divider to the gas header through the upper heat transfer pipe.

4. The outdoor heat exchanger according to claim 1, wherein when a length of a flow path from the first flow divider to the gas header through the second flow divider is denoted by L, the second flow divider is provided at a position of 0.4 L to 0.6 L in the flow path when viewed from the first flow divider.

5. The outdoor heat exchanger according to claim 1, wherein an inner diameter of each of the two branch paths is smaller than an inner diameter of the merging path.

6. The outdoor heat exchanger according to claim 5, wherein an interval between fins provided on the two branch paths is smaller than an interval between fins provided on the merging path.

7. The outdoor heat exchanger according to claim 1, wherein the second flow divider is formed by inserting a merging pipe located at an end portion of the merging path into a branch pipe connecting end portions of the two branch paths, and the branch pipe extends in a vertical direction, and the second flow divider is configured such that the refrigerant flowing out of the merging pipe collides with an inner wall of the branch pipe.

8. The outdoor heat exchanger according to claim 1, wherein the second flow divider is formed by connecting a merging pipe located at an end portion of the merging path to a branch pipe connecting end portions of the two branch paths, and the branch pipe extends in a horizontal direction.

9. The outdoor heat exchanger according to claim 1, wherein the second flow divider is formed by connecting a merging pipe located at an end portion of the merging path to a branch pipe connecting end portions of the two branch paths, and the branch pipe extends in a vertical direction, and an inner diameter at an upper end of the branch pipe is larger than an inner diameter at a lower end of the branch pipe.

10. The outdoor heat exchanger according to claim 1, further comprising:

a subcooling heat exchanger connected to the first flow divider, wherein the subcooling heat exchanger includes a plurality of refrigerant paths, and a flow divider that merges the plurality of refrigerant paths into one refrigerant path is connected to the subcooling heat exchanger.

11. An air conditioner comprising:

an outdoor unit and an indoor system, wherein the outdoor unit includes the outdoor heat exchanger according to claim 1, a compressor, and a four-way valve, the air conditioner performs a heating operation when the outdoor heat exchanger operates as an evaporator, and the air conditioner performs a cooling operation when the outdoor heat exchanger operates as a condenser.

12. The outdoor heat exchanger according to claim 1, wherein the upper heat transfer pipe comprises two or more upper heat transfer pipes including respective merging paths connected to the first flow divider, respective second flow dividers provided at respective end portions of the respective merging paths, and two respective branch paths branched from the respective second flow dividers.

* * * * *